US005496029A

United States Patent [19]

Heath et al.

[11] Patent Number: 5,496,029

[45] Date of Patent: Mar. 5, 1996

[54] ADJUSTABLE GOLF SHAFT

[76] Inventors: Jeffrey R. Heath, 746 Fruithurst Dr.; Rodney Stevens, 836 Fruithurst Dr., both of Pittsburgh, Pa. 15228

[21] Appl. No.: 304,936

[22] Filed: Sep. 13, 1994

[51] Int. Cl.[6] ..... A63B 69/36; A63B 53/16

[52] U.S. Cl. ..... 273/80 D; 273/81.2

[58] Field of Search ..... 273/80 R, 80 D, 273/193 R, 194 R, 80.1, 67 R, 162 R, 79, 81.2

[56] References Cited

U.S. PATENT DOCUMENTS

| | | | |
|---|---|---|---|
| 1,634,082 | 6/1927 | Rigby | 273/80 D |
| 1,650,183 | 11/1927 | Brooks | 273/80 D |
| 3,102,726 | 9/1963 | Barrett | 273/80 D |
| 3,516,697 | 6/1970 | Hahn | 273/80 R |
| 3,524,646 | 8/1970 | Wheeler | 273/80 D |
| 3,663,019 | 5/1972 | Palotsee | 273/80 D |
| 4,932,661 | 6/1990 | Choi . | |
| 5,024,438 | 6/1991 | Candow . | |
| 5,282,619 | 2/1994 | Napolitano | 273/80 D |

*Primary Examiner*—Sebastiano Passaniti

*Attorney, Agent, or Firm*—Buchanan Ingersoll; Robert J. Pugh

[57] ABSTRACT

An adjustable golf shaft for a golf club which allows a child to use the same set of golf clubs during childhood and into his or her teen years. The golf shaft has a first shaft member, a second shaft member telescopically positioned within the first shaft member, and a compression fitting which fixedly attaches the first shaft member to the second shaft member at a desired golf shaft length. As the child grows, the compression fitting can be loosened, the second shaft member can be expanded outward from the first shaft member lengthening the golf shaft, and the compression fitting can be tightened fixing the first shaft member relative to the second shaft member.

10 Claims, 3 Drawing Sheets

10
12
14
16
18
20
22
24
26
27
28
30
32
33
34
36
38

ADJUSTABLE GOLF SHAFT

BACKGROUND OF THE INVENTION

1. Field of the Invention

This invention relates to an adjustable length golf shaft for a set of golf clubs that can be used by a golfer through childhood and into his or her early teen age years. More particularly, this invention concerns a golf shaft having a first shaft member, a second shaft member telescopically positioned within the first shaft member such that the length of the golf shaft is adjustable, and compressing means for fixedly attaching the first shaft member and the second shaft member relative to one another at a desired length.

2. Description of the Prior Art

Golfing is becoming more prevalent among junior golfers, children between approximately five (5) and approximately fourteen (14) years of age. The average height of a five-year old child is forty-four inches (44"). By the time the child reaches fourteen years of age he or she will have grown an additional twenty inches (20") to an average height of sixty-four inches (64"). During these years of growing the child will need to be refitted for golf clubs every one and a half years. If a new set of golf clubs is bought every one and a half years, the expense will be great. If a longer set of golf clubs is not purchased, the child will compensate for the short golf clubs by developing an improper golf swing.

A golf club can be lengthened by removing the grip of the golf club, attaching an extender butt to the end of the golf shaft, and then regripping the golf club. This can be expensive and time consuming.

An example of an extension for a putter is described in U.S. Pat. No. 5,024,438 to Candow. The putter extension is used in order that the golfer may be at a more upright position when putting. The length of the putter is extended by removing the grip from the putter, placing a receiving sleeve within a cavity that extends longitudinally within the putter shaft, positioning an extension shaft into the receiving sleeve, and placing a grip over the extension shaft. The receiving sleeve is anchored into the putter shaft with an expansion joint. The disadvantage to this type of extension is that the process is both tedious and expensive. Furthermore, this type of extension device is used to extend the length of a putter but is not strong enough to withstand the stresses on a shaft of a driver or an iron resulting from the golf head impacting a golf ball.

Retractable golf clubs are known which allow a person to fold the golf club to a size such that it can be carried in a briefcase. However, this type of golf club is not adjustable to more than one playing length. This golf club is only adjustable to a second length for transporting purposes.

None of the above-mentioned prior art disclose a golf shaft for a golf club that can be adjusted to various playing lengths while being able to withstand stresses resulting from the golf club head impacting a golf ball. Therefore, there is a need for an adjustable length golf shaft that is capable of handling these stresses and would allow a child to use the same set of golf clubs throughout his or her youth.

SUMMARY OF THE INVENTION

The present disclosure provides an adjustable length golf shaft for golf clubs which allow individual golf clubs to be lengthened as needed as a child grows. The adjustable golf shaft substantially comprises a first shaft member, a second shaft member, and means for compressing the first shaft member around the second shaft member such that when the head of a golf club impacts a golf ball the first shaft member and the second shaft member remain fixed relative to one another.

The means for compressing the first shaft member around the second shaft member is preferably operated with minimal effort such that the overall length of the shaft may be changed quickly and easily. Further, the compressing means is preferably able to repeatedly fix the first shaft member relative to the second shaft member without showing signs of wear. This is important because the length of the golf shaft could be adjusted many times during the life of the club. We prefer that the compressing means be a connection fitting having a bolt and nut that are positioned on the golf shaft, and a compression ring positioned between the golf shaft and the nut.

The length of the golf shaft is preferably adjustable such that the golf club will properly fit a child between the ages of approximately five years of age and approximately fourteen years of age. Preferably, the adjustable length of the golf shaft from a collapsed position to a fully extended position is approximately ten inches (10").

We further provide a connection between the first shaft member and the second shaft member which prevents the two shaft members from separating from one another after the golf club has been assembled. A golf club travels at extremely fast rates during a golf swing. If the golfer did not engage the compressing means properly before swinging the golf club, it is possible that the two shaft members could separate resulting in an accident involving the golfer or a bystander. The connection we provide acts as a safety preventing the two shaft members from separating from one another.

The adjustable length golf shaft is also provided with a structure which prevents the first shaft member and the second shaft member from rotating relative to one another during the swinging of the golf club. By preventing rotation of the two shaft members, the club head will remain at the proper position when addressing a golf ball and after hitting the golf ball. If the golf club head is able to move during the swing relative to the golf ball, the golf ball could slice or the head of the golf club could miss the golf ball completely.

Other details, objects and advantages of the invention will become apparent as the following description of the present preferred embodiments thereof proceed.

DETAILED DESCRIPTION OF THE DRAWINGS

Figures 1, 2, 3, 4, 5, 6, 7:
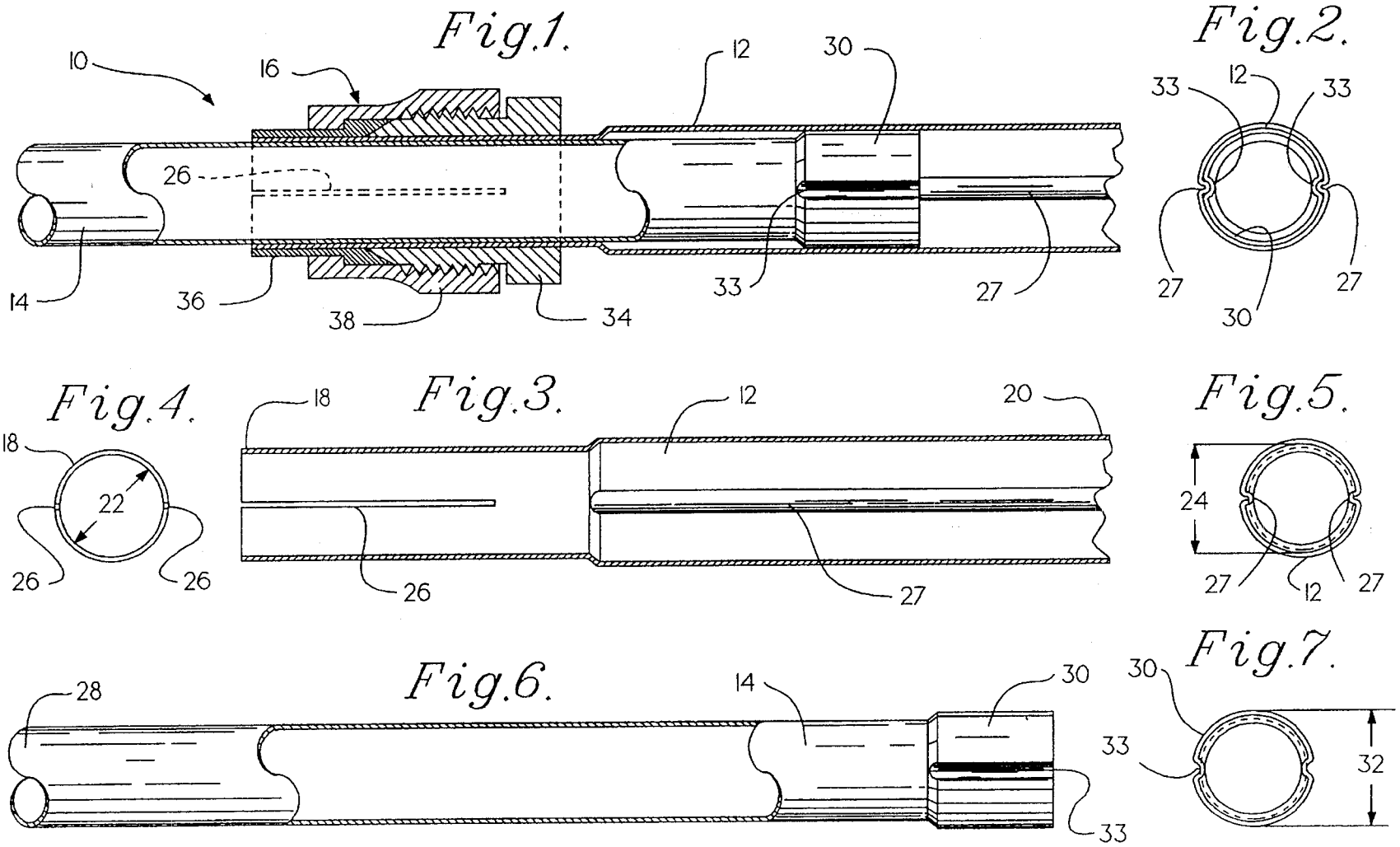
FIG. 1 is a partial sectional view of the present preferred embodiment of the adjustable golf shaft.
FIG. 2 is an end elevational view of an adjustable golf shaft shown in FIG. 1.
FIG. 3 is a sectional view of a first shaft member of the adjustable golf shaft shown in FIG. 1.
FIG. 4 is an end elevational view of the first shaft member of the adjustable golf shaft shown in FIG. 3 taken at a first end of the first shaft member.
FIG. 5 is an end elevational view of the first shaft member of the adjustable golf shaft shown in FIG. 3 taken at a second end of the first shaft member.
FIG. 6 is a partial sectional view of a second shaft member of the adjustable golf shaft shown in FIG. 1.
FIG. 7 is an end elevational view of the second shaft member of the adjustable golf shaft shown in FIG. 6 taken at a second end of the second shaft member.

FIG. 1 illustrates the preferred embodiment of the adjustable length golf shaft. The adjustable golf shaft 10 substantially comprises a first shaft member 12, a second shaft member 14 which is telescopically positioned within the first shaft member 12, and means 16 for compressing the first shaft member 12 around the second shaft member 14 fixedly attaching the first shaft member 12 and the second shaft member 14 relative to one another.

FIGS. 3 through 5 show the first shaft member 12 in greater detail. The first shaft member 12 has a first end 18 and a second end 20. The first end 18 of the first shaft member 12 has an inner diameter 22. Further, the second end 20 of the first shaft member 12 has an inner diameter 24 which is greater than the inner diameter 22 of the first end 18. Preferably the first shaft member 12 is stepped to accommodate the change in inner diameter of the first shaft member 12. Also, it is preferred that at least one slot 26 is provided at the first end 18 of the first shaft member 12. The first shaft member 12 is illustrated as having two slots 26 in FIGS. 3 and 4, however, any number of slots 26 may be provided. The slots 26 are preferably equally spaced about the circumference of the first shaft member 12. Although the slots 26 are shown as being aligned with the longitudinal axis of the first shaft member 12, the slots can be positioned at an angle relative to the longitudinal axis of the first shaft member 12. Longitudinal ridges 27 are also preferably positioned on the interior surface of the second end 20 of the first shaft member as shown in FIGS. 3 and 5.

The second shaft member 14 is shown in greater detail in FIGS. 6 and 7. The second shaft member 14 has a first end 28 and a second end 30. The second end 30 of the second shaft member 14 has an outer diameter 32 which is less than the inner diameter 24 of the first shaft member second end 20 but is larger than the inner diameter 22 of the first shaft member first end 18. Preferably, grooves 33 are formed on the exterior surface of the second end 30 of the second shaft member 14. The grooves 33 are sized and positioned to mate with the ridges 27 of the first shaft member 12 as can be seen best in FIG. 2.

Figure 8:
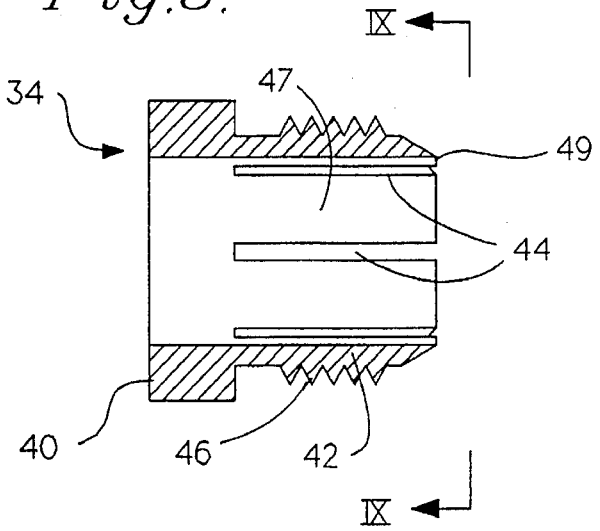
FIG. 8 is a sectional view of a bolt of the compressing means of the adjustable golf shaft shown in FIG. 1.
Figure 9:
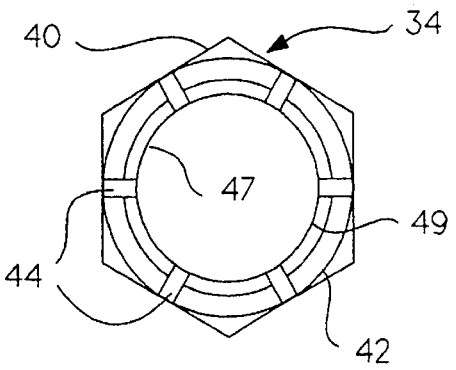
FIG. 9 is a removed view of the bolt shown in FIG. 8 taken along line IX—IX.

The compressing means 16 depicted in FIG. 1 is preferably a connection fitting which substantially comprises a bolt 34, a compression ring 36 and a nut 38. The components of the compressing means are shown in greater detail in FIGS. 8 through 13. Referring first to FIGS. 8 and 9, the bolt 34 has a head 40 and a hollow cylindrical rod 42 extending from the head 40. Hollow cylindrical rod 42 is threaded so as to have external threads 46 provided thereon. The cylindrical rod 42 is further preferably provided with a plurality of longitudinal slits 44. The slits 44 divide the cylindrical rod 42 forming teeth 47. The distal ends 49 of the bolt teeth 47 are tapered. The degree of taper of bolt teeth 47 is selected so that the distal ends 49 of the bolt teeth 47 substantially mate with a beveled surface of the compression ring (described in detail below). The bolt head 40 is preferably hexagonal such that the bolt head 40 may be easily manipulated by a wrench or pair of pliers, however, any suitable configuration of bolt head 40 may be utilized.

Figure 10:
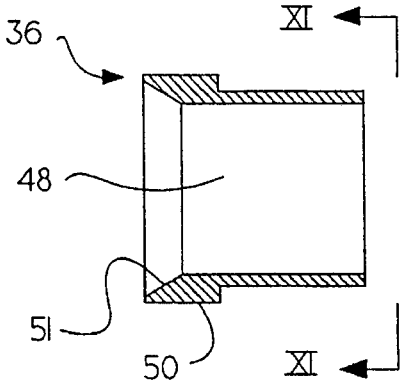
FIG. 10 is a sectional view of a compression ring of the compressing means of the adjustable golf shaft shown in FIG. 1.
Figure 11:
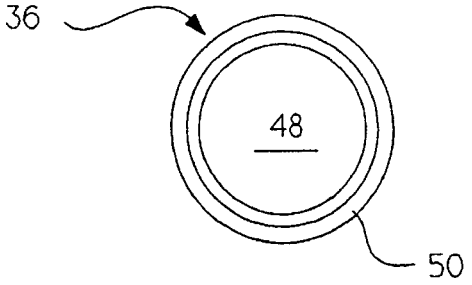
FIG. 11 is a removed view of the compression ring shown in FIG. 10 taken along line XI—XI.

Referring next to FIGS. 10 and ill, the compression ring 36 is also generally cylindrical with an aperture 48 that extends the entire length of the compression ring 36. The compression ring 36 has an enlarged rim 50 extending around an exterior surface of the compression ring 36 and further has a beveled surface 51 extending around a portion of an interior surface of the compression ring at enlarged rim 50. Beveled surface 51 is preferred to be angled at between 0° and 45° from the longitudinal axis of the ring 36 and the golf shaft 10. Although any such angle may be utilized, the preferred angle at which surface 51 is beveled is approximately 20°. Thus, the preferred angle of taper of the distal ends 49 of bolt teeth 47 (which mate with the compression ring beveled surface 51) is also 20°. It is understood, however, that the angle of taper of the bolt teeth distal ends 49 and the angle at which surface 51 is beveled need not be identical for beveled surface 51 to contact bolt teeth distal ends 49.

Figure 12:
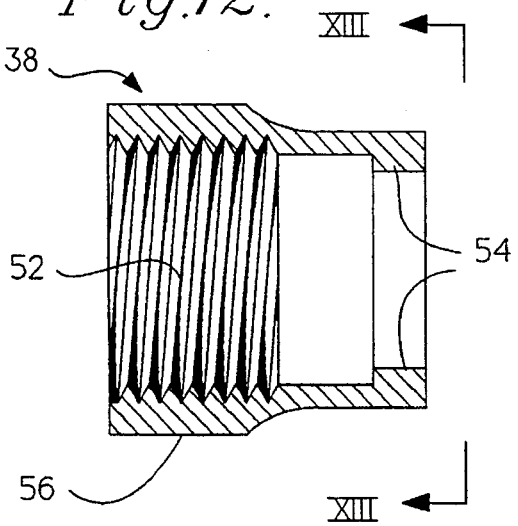
FIG. 12 is a sectional view of a nut of the compressing means of the adjustable golf shaft shown in FIG. 1.
Figure 13:
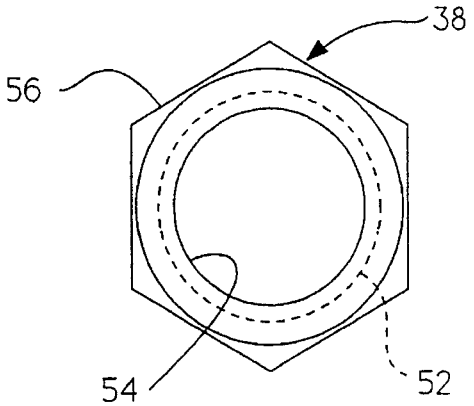
FIG. 13 is a removed view of the nut shown in FIG. 12 taken along line XIII—XIII.

Referring next to FIGS. 12 and 13, the nut 38 is substantially cylindrical and has internal threads 52 provided thereon. Internal threads 52 are sized and configured to mate with the external threads 46 of the bolt 34. An internal lip 54 which extends towards the center line of the nut 38 is provided at one end of the nut 38. The exterior surface 56 of the nut 38 preferably has a roughened surface or, alternatively, is hexagonally shaped to facilitate manipulation of the nut 38.

Figure 14:
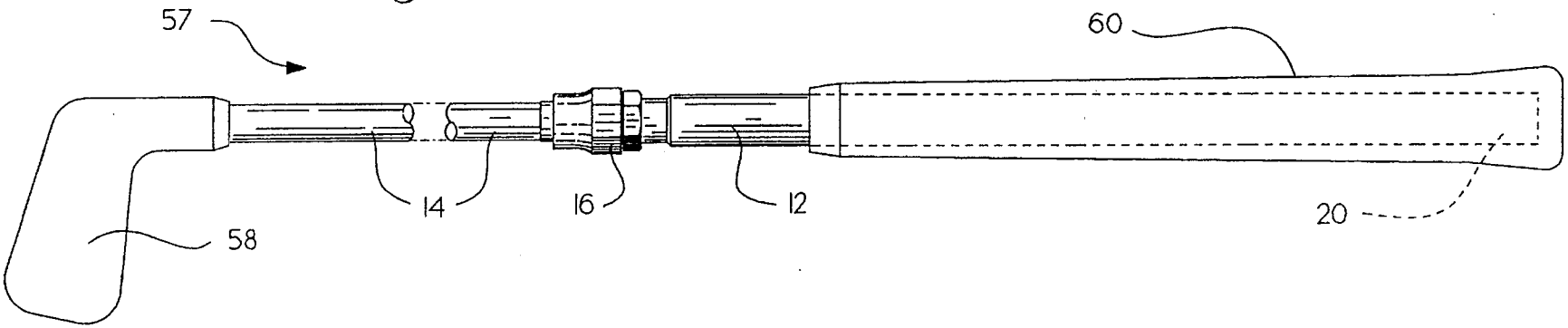
FIG. 14 is a broken elevational view of the adjustable golf shaft shown in FIG. 1.

To assemble the adjustable golf shaft 10 shown in FIG. 1 in a golf club 57 illustrated in FIG. 14, the second shaft member 14 is positioned within the first shaft member 12 by placing the first end 28 of the second shaft member 14 into the second end 20 of the first shaft member 12 because the outer diameter 32 at the second end 30 of the second shaft member 14 fits within the second end 20 of the first shaft member 12 but cannot fit within the first end 18 of the first shaft member 12. This physical relationship prevents the first shaft member 12 and the second shaft member 14 from separating from one another during the swinging of the golf club 57. When placing the second shaft member 14 within the first shaft member 12, the ridges 27 of the first shaft member 12 and the grooves 33 of the second shaft member 14 are aligned so that they mate with each other as shown in FIG. 2. Although the first shaft member 12 and the second shaft member 14 are shown having two ridges and two grooves, respectively, any number of mating ridges and grooves can be provided such as a key connection having one ridge and one groove. Moreover, any connection can be used which prevents the first shaft member 12 from rotating relative to the second shaft member 14.

The bolt 34, the compression ring 36 and the nut 38, respectively, are then slid onto the assembled first shaft member 12 and the second shaft member 14. Bolt 34 is disposed around the first shaft member first end 18. The bolt 34 is preferably sized and configured so as to fit snugly around the first shaft member first end 18. Bolt 34 is oriented such that the distal ends 49 of the bolt teeth 47 are directed away from the first shaft member second end 20. Next, compression ring 36 is disposed around the first shaft member 12 and second shaft member 14 at the first end 18 of the first shaft member 12. Compression ring 36 is oriented such that beveled surface 51 is directed towards the tapered distal ends 49 of the bolt teeth 47. Then, nut 38 is provided around the first shaft member 12, the second shaft member 14, the compression ring 36 and is placed in threaded engagement with bolt 34.

A golf head 58 is then permanently connected to the second shaft member first end 28 and a grip 60 is attached to the first shaft member second end 20 (see FIG. 14). The golf club head 58 could be a head for a driver, an iron or a putter. When the head 58 and the grip 60 are permanently positioned on the adjustable golf shaft 10, the length of the golf shaft 10 can be adjusted to fit the height of the golfer. The length of the adjustable golf shaft 10 can be adjusted by telescoping the second shaft member 14 further in or out of the first shaft member 12. The adjustable golf shaft 10 can be positioned at any length between a collapsed position and a fully extended position. In the collapsed position, a greater length of second shaft member 14 is provided within the first shaft member 12, thus resulting in a club having a reduced overall length. As adjustable golf shaft 10 is moved toward the extended position, the second shaft member 14 is withdrawn from the first shaft member 12, thus resulting in an overall club length greater than the club length in the collapsed position. The difference in the length of the golf shaft 10 in the collapsed position and the fully extended position is preferably approximately ten inches (10").

To engage the compressing means 16 so that the length of the golf shaft 10 may be fixed, first the first shaft member 12 is positioned to its desired axial location relative to the second shaft member 14. Then, the nut 38 is turned relative to the bolt 34 wherein the external threads 46 of the bolt 34 are engaged by the internal threads 52 of the nut 38. When the external threads 46 of the bolt 34 fully engage the internal threads 52 of the nut 38, the enlarged rim 50 of the compression ring 36 will be contacted by the lip 54 of the nut 38. In this way, the beveled surface 51 of the compression ring 36 is carried towards the distal ends 49 of the bolt teeth 47. The beveled surface 51 of the compression ring 36 mates with the tapered bolt teeth distal ends 49. The individual teeth 47 of the bolt 34 are directed inward by the beveled surface 51 of the compression ring 36. Bolt teeth 47, in turn, are forced inward around the first shaft member first end, resulting in the first end 18 of the first shaft member 12 being compressed radially around the second shaft member 14 to form a tight connection. The slot 26 on the first end 18 of the first shaft member 12 allows the first end 18 of the first shaft member 12 to contract around the second shaft member 14 to form a tight joint. Although the compression means 16 is illustrated as the combination of the bolt 34, the nut 38 and the compression ring 36, other connection devices can be used to maintain the first shaft member around the second shaft member.

To disengage the compressing means 16, the nut 38 is turned in an opposite direction relative to the bolt 34 so that the internal threads of the nut 38 travel out of the external threads 46 of bolt 34. Thus, the beveled surface 51 of the compression ring 36 is no longer forced upon bolt teeth 47. Likewise, bolt teeth 47 no longer force the first shaft member first end 18 around the second shaft member 14.

The length of the adjustable golf shaft 10 may be altered to a desired length by disengaging the compressing means and positioning the first shaft member 12 and the second shaft member 14 to provide the desired length. The nut 38 should then be turned relative to the bolt 34 until the first shaft member 12 is fixedly attached to the second shaft member 14 as described above.

The first and second shaft members may be manufactured of any suitable material or combinations of materials. Preferred materials include stainless steel, titanium, graphite, aluminum, fiberglass and plastic.

Figure 15:
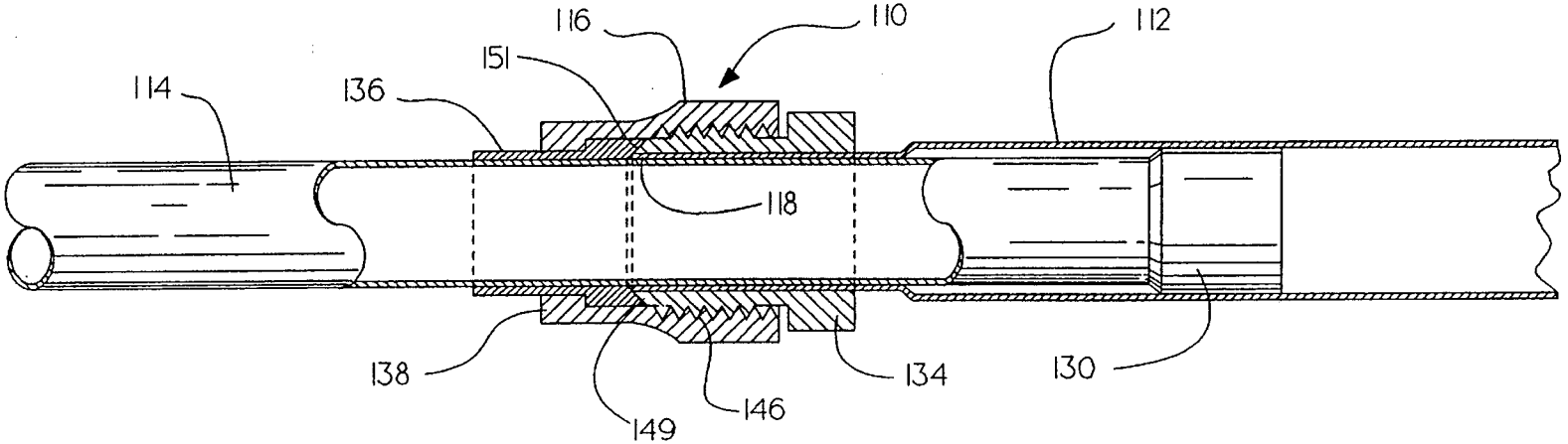
FIG. 15 is a partial sectional view of a second preferred embodiment of the adjustable golf shaft.

Referring next to FIG. 15, a second preferred embodiment of the adjustable golf shaft 110 is shown wherein like numerals are used to represent like structure. The adjustable golf shaft shown in FIG. 15 is substantially similar to the first preferred adjustable golf shaft described above in that it substantially comprises a first shaft member 112, a second shaft member 114 which is telescopically positioned within the first shaft member 112, and means 116 for compressing the first shaft member 112 around the second shaft member 114, fixedly attaching the first shaft member 112 and second shaft member 114 relative to one another. The compressing means 116 of this embodiment also substantially compresses a bolt 134, a compression ring 136 and a nut 138. The second preferred adjustable golf shaft 110 shown in FIG. 15 is distinguished from the first preferred golf shaft of FIG. 1 in that compression ring 136 is provided around second shaft member 114 but is not provided around first shaft member 112. The compression ring 136 fits over the second shaft member 114, adjacent to the first end of the first shaft member. Nut 138 is then provided around the compression ring 136 and is threadably engaged with the bolt external threads 146. The beveled surface 151 of the compression ring 136 mates with the tapered ends 149 of bolt 134.

While presently preferred embodiments of the invention have been described it is to be distinctly understood that the invention is not limited thereto, but may be otherwise embodied and practiced within the scope of the following claims.

We claim:

1. A golf shaft for a golf club having a head and a grip, the golf shaft comprising:

(a) a first shaft member having a first end, a second end, an inner diameter and an outer diameter;

(b) a second shaft member having a first end, a second end, and an outer diameter, the second shaft member telescopically positioned within the first shaft member, the second shaft member outer diameter at the second end being larger than the first shaft member inner diameter at the first end whereby the second shaft member can not be separated from the first shaft member by extracting the second shaft member second end through the first shaft member first end; and (c) means for compressing the first shaft member first end around the second shaft member to fixedly attach the first shaft member to the second shaft member at one of a plurality of locations along the length of the second shaft member such that when the head of the golf club impacts a golf ball the first shaft member and the second shaft member will remain in a fixed longitudinal relationship with respect to each other wherein the compression means comprises a bolt having a head and a hollow cylindrical rod extending from the head, the cylindrical rod having external threads and at least one longitudinal slit allowing the inner diameter of the rod to decrease to a diameter smaller than the outer diameter of the first shaft member first end, the bolt slidably positioned on the first shaft member;

a nut having internal threads that mate with the external threads of the bolt and slidably positioned on the golf shaft; and a compression ring positioned between the golf shaft and the nut.

2. The golf club of claim 1 wherein the length of the golf shaft can be adjusted through a fully extended position and a collapsed position where the length of the golf shaft in the fully extended position is approximately ten (10") inches longer than the golf shaft in the collapsed position.

3. The golf club of claim 1 wherein the first shaft member first end has at least one slot.

4. The golf shaft of claim 3 wherein the first shaft member first end has a plurality of slots which are parallel to the longitudinal axis of the golf shaft, the plurality of slots being equally spaced around the circumference of the first shaft member.

5. The golf shaft of claim 1 further comprising one of the first shaft member and the second shaft member having at least one longitudinal ridge and the other of the first shaft member and the second shaft member having at least one longitudinal groove which mate with the at least one longitudinal ridge to prevent the first shaft member and the second shaft member from rotating relative to one another when the golf club head impacts the golf ball.

6. The golf shaft of claim 1 wherein both the first shaft member and the second shaft member are made of a material selected from the group consisting of titanium, stainless steel, graphite, aluminum, plastic and fiberglass.

7. The golf shaft of claim 1 further comprising a head connected to the second shaft member first end and a grip on the first shaft member second end.

8. The golf shaft of claim 7 wherein the compressing means is proximate to the grip.

9. The golf shaft of claim 8 wherein the compressing means is within approximately four inches (4") of the grip.

10. The golf shaft of claim 1 wherein the first shaft member and the second shaft member both have a substantially smooth outer surface.

* * * * *